US007731276B2

(12) United States Patent
Hoffman et al.

(10) Patent No.: US 7,731,276 B2
(45) Date of Patent: Jun. 8, 2010

(54) RECLINING SEATING UNIT WITH WALL-PROXIMITY CAPABILITY

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 11/834,138

(22) Filed: Aug. 6, 2007

(65) Prior Publication Data

US 2008/0036248 A1 Feb. 14, 2008

Related U.S. Application Data

(60) Provisional application No. 60/821,745, filed on Aug. 8, 2006.

(51) Int. Cl.
*A47C 1/02* (2006.01)

(52) U.S. Cl. ..... 297/85 R; 297/259.2

(58) Field of Classification Search ..... 297/83, 297/84, 85, 259.2

See application file for complete search history.

(56) References Cited

U.S. PATENT DOCUMENTS

| | | | | |
|---|---|---|---|---|
| 4,071,276 | A * | 1/1978 | Cecil | 297/85 |
| 4,077,663 | A | 3/1978 | Cycowicz et al. | |
| 4,212,495 | A * | 7/1980 | Gall | 297/84 |
| 4,270,796 | A * | 6/1981 | Preston | 297/69 |
| 4,337,977 | A | 7/1982 | Rogers, Jr. et al. | |
| 4,531,778 | A | 7/1985 | Rogers, Jr. | |
| 4,805,960 | A | 2/1989 | Tacker | |
| 5,129,701 | A * | 7/1992 | Pine | 297/68 |
| 5,588,710 | A | 12/1996 | Wiecek | |
| 5,992,930 | A | 11/1999 | LaPointe et al. | |
| 6,231,120 | B1 * | 5/2001 | Wiecek | 297/84 |
| 6,988,769 | B2 * | 1/2006 | LaPointe | 297/85 |
| 7,328,949 | B2 * | 2/2008 | Donovan et al. | 297/259.2 |

* cited by examiner

*Primary Examiner*—David Dunn
*Assistant Examiner*—Patrick Lynch
(74) *Attorney, Agent, or Firm*—Myers Bigel Sibley & Sajovec

(57) ABSTRACT

A seating unit includes: a frame having arms on opposing sides thereof, the frame located in a first position relative to an underlying surface that supports the seating unit; a backrest; a seat; and a reclining mechanism attached to the frame, backrest and seat. The reclining mechanism comprises a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being smaller than the first angle, and the seat is in a second location relative to the frame that is forwardly of the first location. The reclining mechanism includes a cam unit having a generally arcuate bearing surface in contact with a contact surface, wherein movement of the backrest to the reclined position rolls the bearing surface on the contact surface, thereby driving the backrest and seat forward.

20 Claims, 5 Drawing Sheets

RECLINING SEATING UNIT WITH WALL-PROXIMITY CAPABILITY

RELATED APPLICATION

This application claims priority from U.S. Provisional Patent Application No. 60/821,745, filed Aug. 8, 2006 and entitled Reclining Seating Unit With Wall-Proximity Capability, the disclosure of which is hereby incorporated herein in its entirety.

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "wall-proximity" chair. In a conventional reclining chair, as the backrest moves to the reclined position, the tipper end of the backrest moves rearwardly relative to the base of the chair. As a result, typically the chair cannot be positioned such that the backrest is adjacent a wall, as the reclining backrest would strike the wall and thereby be prevented from fully reclining. A wall-proximity" reclining chair includes some type of mechanism (typically either a linkage or a set of wheels that roll on a track) that move the seat of the chair forward relative to the base to provide additional room for the backrest to recline. Exemplary wall-proximity chairs are illustrated in U.S. Pat. No. 4,077,663 to Cycowicz et al., U.S. Pat. No. 4,337,977 to Rogers et al., U.S. Pat. No. 4,531,778 to Rogers, U.S. Pat No.4,805,960 to Tacker, U.S. Pat. No. 5,588,710 to Wiecek, and U.S. Pat. No. 5,992,930 to LaPointe et al., the disclosures of each of which are hereby incorporated herein in their entireties. A typical wall-proximity chair in an upright position can be placed with the backrest within 3 to 4 inches of an adjacent wall.

One potential shortcoming of wall-proximity chairs is that the wall-proximity mechanism or wheel/rail system is typically somewhat complex, with multiple interconnected intricate parts. As such, production of these mechanisms can be relatively expensive. Consequently, it would be desirable to provide a relatively uncomplicated and inexpensive wall-proximity mechanism.

SUMMARY OF THE INVENTION

The present invention can provide features that may address shortcomings of prior chairs. As a first aspect, embodiments of the present invention are directed to a seating unit comprising: a frame having arms on opposing sides thereof, the frame located in a first position relative to an underlying surface that supports the seating unit; a backrest; a seat; and a reclining mechanism attached to the frame, backrest and seat. The reclining mechanism comprises a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being larger than the first angle, and the seat is in a second location relative to the frame that is forwardly of the first location. The reclining mechanism includes a cam unit having a generally arcuate bearing surface in contact with a contact surface, wherein movement of the backrest to the reclined position rolls the bearing surface on the contact surface, thereby driving the backrest and seat forward. In this configuration, the seating unit can have wall-proximity functionality with relative few components and, in turn, at a lower cost.

As a second aspect, embodiments of the present invention are directed to a reclining seating unit, comprising: a frame having arms on opposing sides thereof, the frame located in a first position relative to an underlying surface that supports the seating unit; a backrest; a seat; and a reclining mechanism attached to the frame, backrest and seat. The reclining mechanism comprises a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being larger than the first angle, and the seat is in a second location relative to the frame that is forwardly of the first location. The reclining mechanism includes a cam unit having front and rear bearing surface portions, wherein in the upright position the rear bearing surface portion is in contact with a contact surface, and wherein in the reclined position the front bearing surface portion is in contact with the contact surface, the movement of the backrest from the upright position to the reclined position moving the cam unit, thereby driving the backrest and seat forward.

As a third aspect, embodiments of the present invention are directed to a reclining seating unit, comprising: a frame having arms on opposing sides thereof, the frame located in a first position relative to an underlying surface that supports the seating unit; a backrest; a seat; and a reclining mechanism attached to the frame, backrest and seat. The reclining mechanism comprises a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being larger than the first angle, and the seat is in a second location relative to the frame that is forwardly of the first location. The reclining mechanism includes a cam unit pivotally interconnected with the frame and having front and rear bearing surface portions, wherein in the upright position the rear bearing surface portion is in contact with the underlying surface, and wherein in the reclined position the front bearing surface portion is in contact with the underlying surface, the movement of the backrest from the upright position to the reclined position moving the cam unit, thereby driving the backrest and seat forward.

DETAILED DESCRIPTION OF EMBODIMENTS OF THE INVENTION

Figure 1:
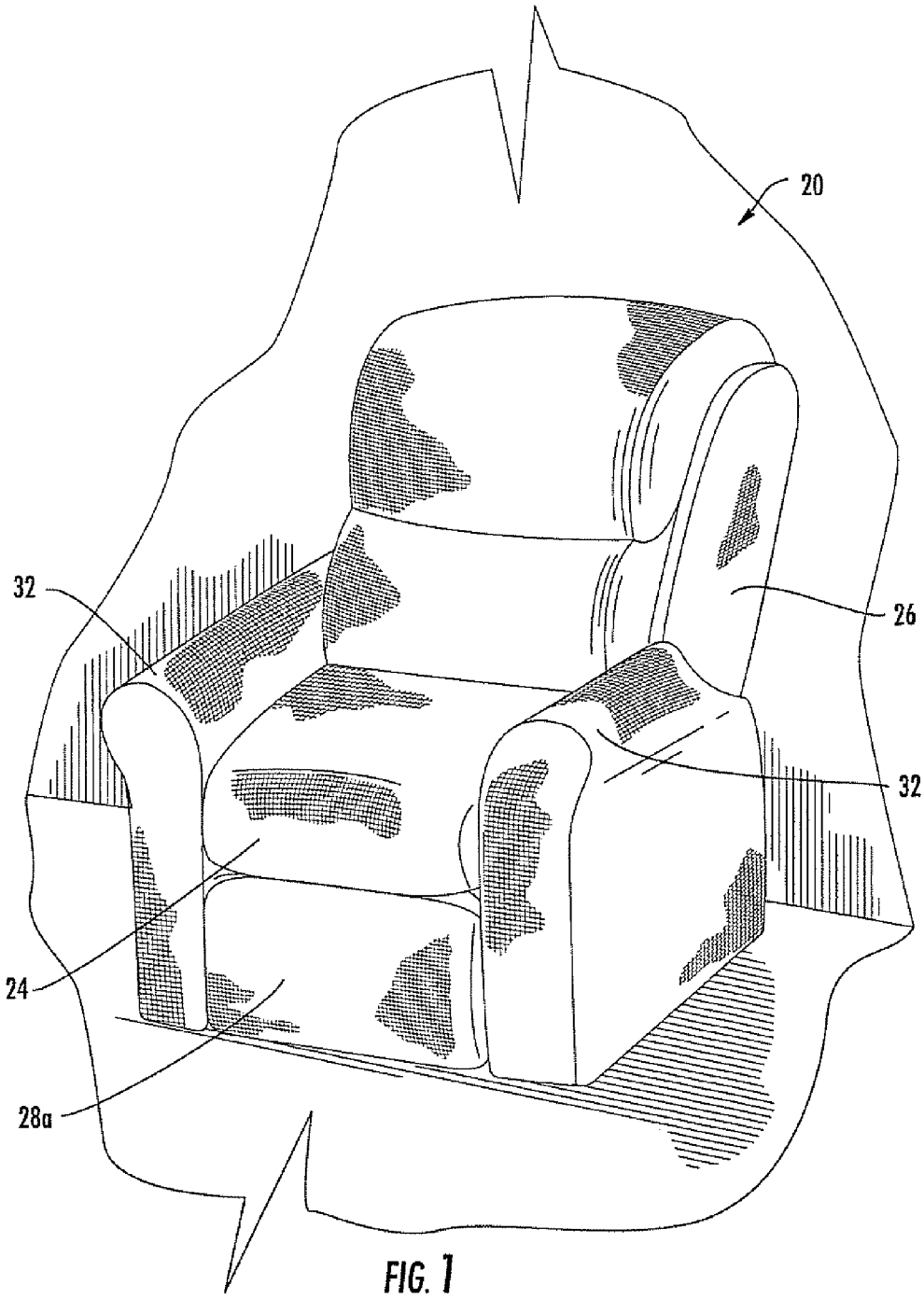
FIG. 1 is a perspective view of a wall proximity recliner chair according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a frame, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a wall-proximity recliner chair, designated broadly at 20, is illustrated in FIGS. 1-5. The chair 20 includes a frame 22 (FIG. 2), a seat 24 that is generally horizontally disposed within the frame 22, a backrest 26 that is generally vertically disposed above a rear portion of the seat 24, and two ottomans 28*a*, 28*b* (only the ottoman 28*a* is visible in FIG. 1), which, in the upright position of FIG. 1, are generally vertically disposed below a front portion of the seat 24 (see FIG. 3).

Figure 2:
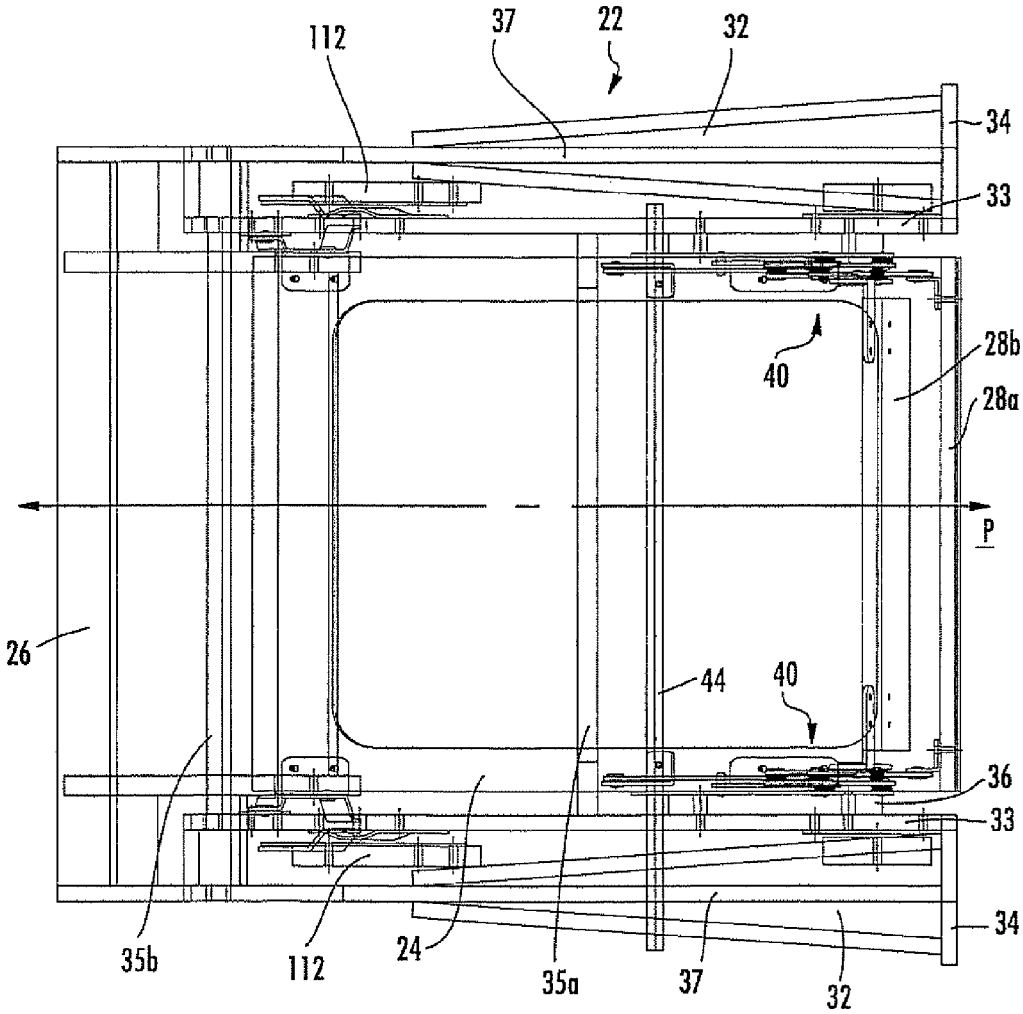
FIG. 2 is a top cutaway view of the frame of the chair of FIG. 1.

As can be seen in FIGS. 1 and 2, the frame 22 includes two arms 32 located on opposite sides of the chair 20. In the illustrated embodiment, the arms 32 are hollow wooden structures with inner panels 33 that form the inboard surface of the arms 32 and front panels 34 that form the front faces of the arms 32. A cross-member 35*a* (see FIG. 2) extends between the inner panels 33 of the arms 32 to provide structural rigidity to the arm frame 30. The frame 22 also includes a brace 37 that extends rearwardly from the front panel 34 at the lower edge of each arm 32. A cross-member 35*b* spans the rear ends of the braces 37 below the backrest 26.

Those skilled in this art will appreciate that other configurations of the base and arm frame may be employed in connection with the present invention. For example, the frame may omit certain of the members described above, include arms that are not hollow, or include more or fewer cross members that spans the inner panels of the arms. Other suitable configurations will be apparent to those of skill in this art.

Figure 3:
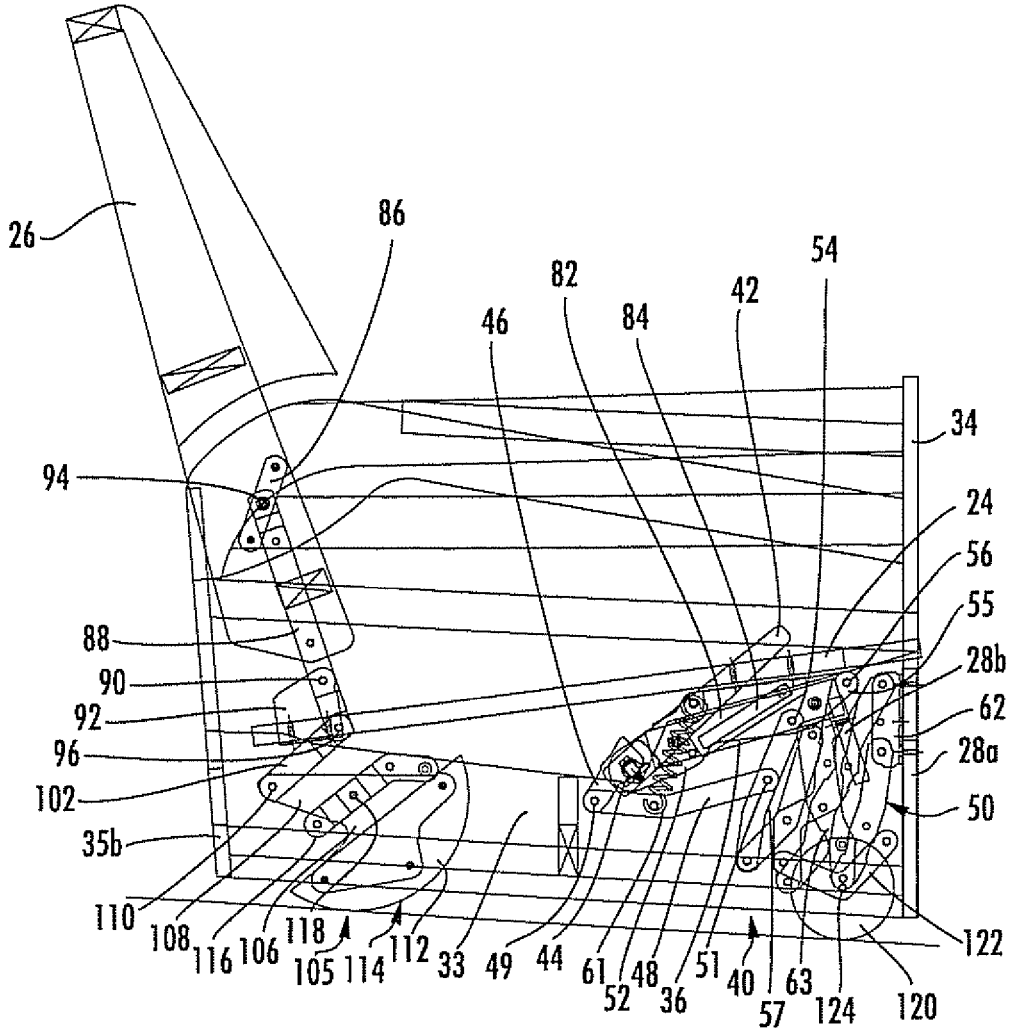
FIG. 3 is a side section view of the chair of FIG. 1 with the backrest in the upright position and the ottoman in the retracted position.
Figure 4:
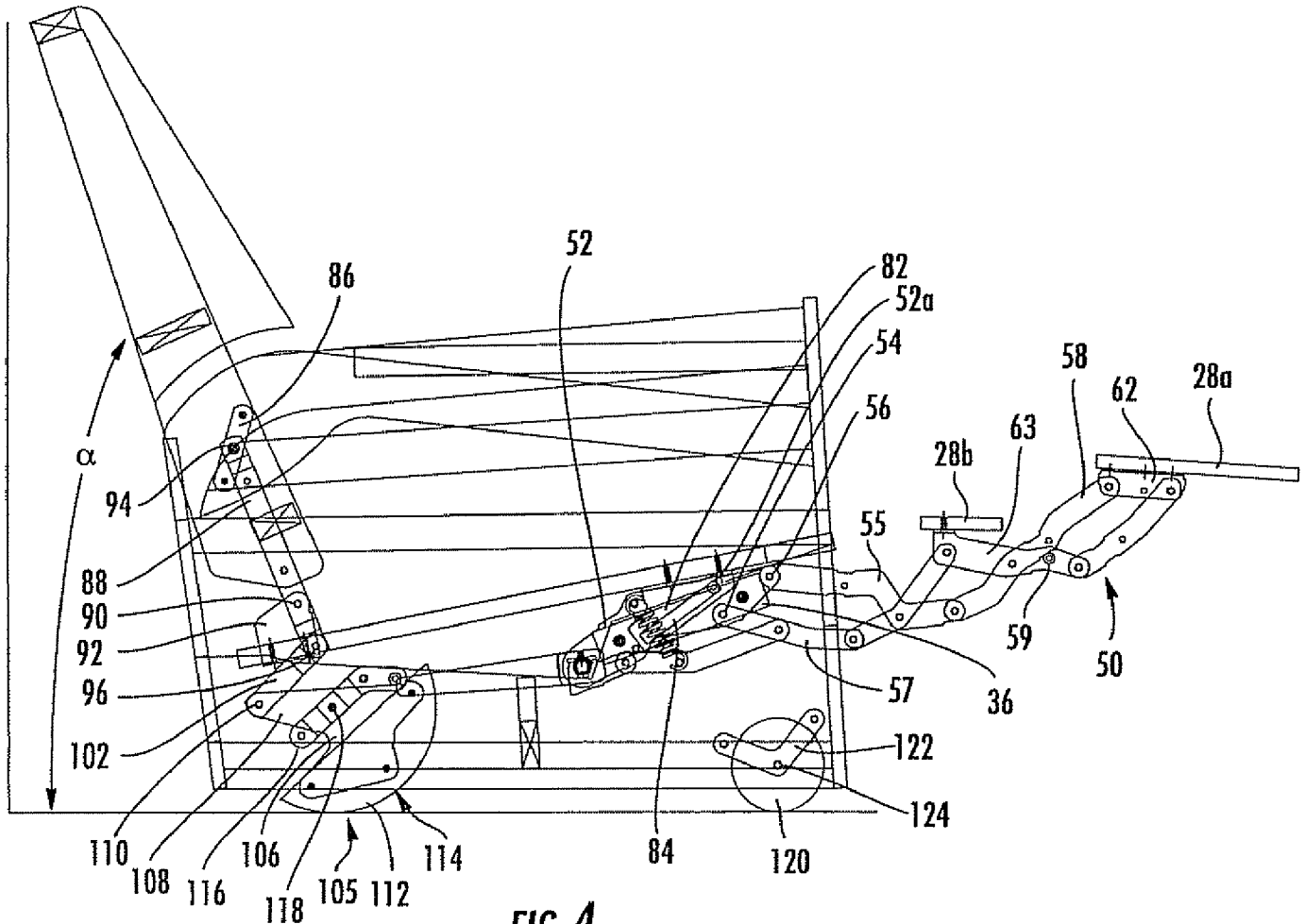
FIG. 4 is a side section view of the chair of FIG. 1 with the backrest in the upright position and the ottoman in the extended position.
Figure 5:
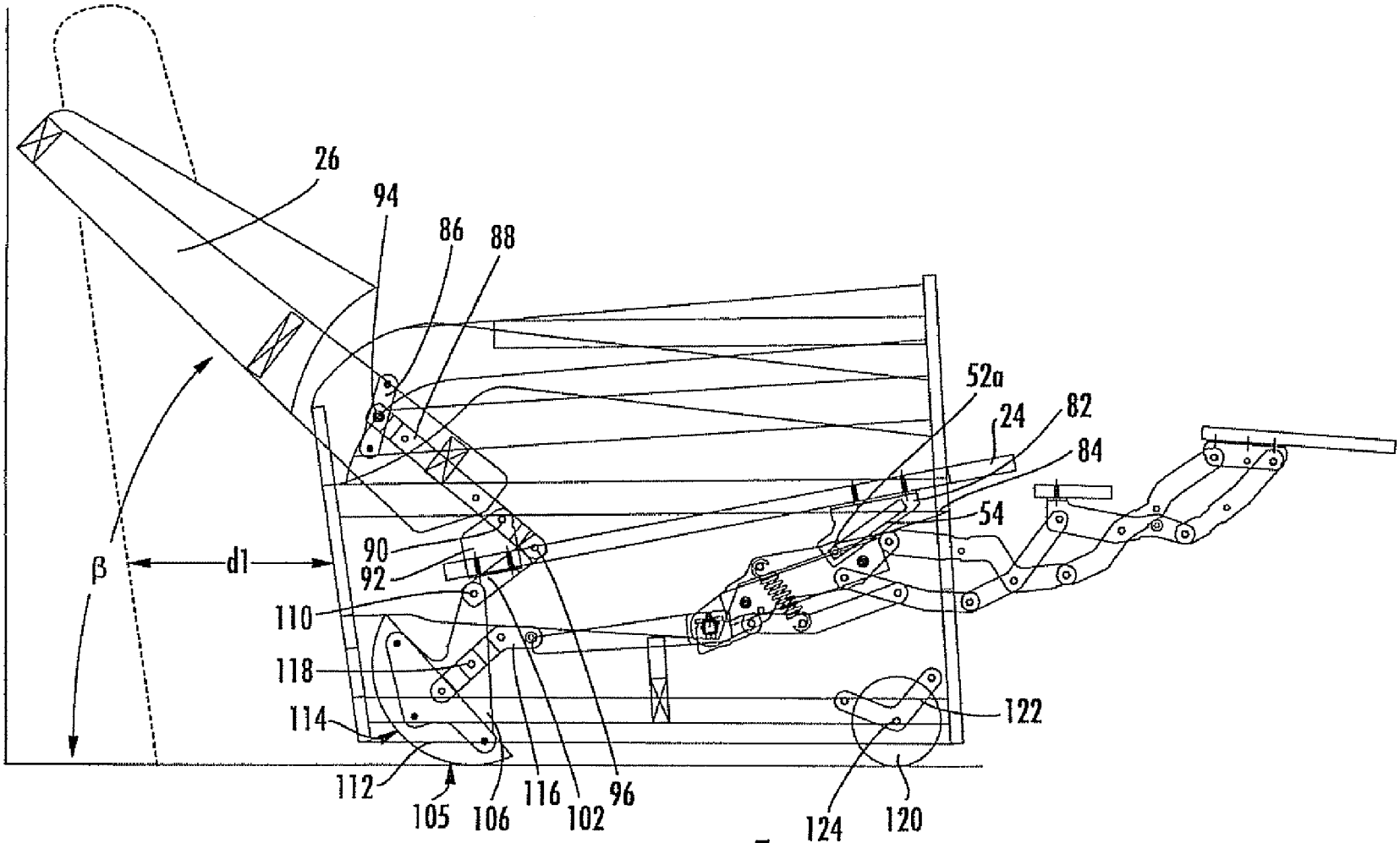
FIG. 5 is a side section view of the chair of FIG. 1 with the backrest in the reclined position and the ottoman in the extended position.

Referring now to FIGS. 3 and 4, the chair 20 includes two ottoman extension mechanisms 40 (only one is shown in FIGS. 3 and 4) that extend the ottomans 28*a*, 28*b* from a retracted position (as seen in FIG. 3), in which the ottomans 28*a*, 28*b* are generally vertically disposed below a front portion of the seat 24, and an extended position, (as seen in FIG. 4), in which the ottomans 28*a*, 28*b* are generally horizontally disposed and forward of the seat 24. The ottoman extension mechanisms 40 are mirror images of each other about a longitudinally-extending vertical plane P (FIG. 2) that bisects the chair 20 between the arms 32; as such, the ensuing discussion will focus on only one of the ottoman extension mechanisms 40, with the discussion being equally applicable to the other ottoman extension mechanism 40 also. Further, the discussion of the ottoman extension mechanism 40 will first discuss its components as they are in the retracted position of FIG. 3, then proceed to discuss their movement to the extended position of FIG. 4.

Referring now to FIG. 3, the ottoman extension mechanism 40 includes a handle 42 mounted on a transversely-extending axle 44 that spans the arms 32 of the arm frame 30 and is rotatably mounted therein. The handle 42 extends forwardly and upwardly from its junction with the axle 44. A crank 46 attaches to the axle 44 at its center portion via a flange and extends downwardly and rearwardly therefrom. The rear end of the crank 46 is pivotally attached to an ottoman drive link 48 at a pivot 49. The ottoman drive link 48 extends generally forwardly from the pivot 49 and terminates at a pivot 51 with a first base link 57 of a pantographic linkage 50 of a known configuration. The first base link 57 and a second base link 55 of the pantographic linkage 50 are mounted to the upper, forward end of a mounting link 52 at pivots 54, 56. The mounting link 52 is, in turn, fixed to a mounting shim 36 that is mounted to the inner panel 33 of the arm 32. A spring 61 extends between the ottoman drive link 48 and the mounting link 52 and, when the ottomans 28*a*, 28*b* are in the retracted position of FIG. 3, is in tension. The ottomans 28*a*, 28*b* are mounted to brackets 62, 63 that are pivotally mounted on the ends of the pantographic linkage 50. The ottoman 28*b* resides below the front edge of the seat 24 and serves as the front panel of the chair 20. The ottoman 28*a* resides rearwardly of the ottoman 28*b*.

The ottomans 28*a*, 28*b* can be moved from the retracted position of FIG. 3 to the extended position of FIG. 4 by an occupant of the chair 20 drawing the upper portion of the handle rearwardly (counterclockwise from the vantage point of FIG. 3). This rotation causes the axle 44 to rotate, which in turn causes the crank 46 to rotate counterclockwise with the axle 44. As the lower end of the crank 46 rotates forwardly, it drives the ottoman drive link 48 forward also. Forward movement of the ottoman drive link 48 forces the first and second base members 55, 57 of the pantographic linkage 50 to rotate counterclockwise about pivots 54, 56. This movement extends the pantographic linkage 50, which carries the ottomans 28*a*, 28*b* to the extended positions shown in FIG. 4. Movement ceases when a pin 59 located on the bracket 63 of the pantographic linkage 50 contacts the edge of an adjoining link 58.

Those skilled in this art will recognize that other mechanisms for extending one or more ottomans from a retracted position to an extended position may also be suitable for use in connection with the present invention. For example, some links illustrated and described herein may be omitted or substituted for, and other links may be added as desired. In addition, the shapes of the links themselves may vary, as may the positions of the pivot points. Also, the handle may be replaced with another variety of actuation mechanism. Some embodiments may have only one, or even three or more, ottomans for extension. Other variations will be apparent to those skilled in this art.

The chair 20 also includes two backrest reclining mechanisms 80 that control the relative movement of the backrest 26, the seat 24, the frame 22 and the underlying surface. The reclining mechanisms 80, which each comprise a series of pivotally interconnected links, are mirror images of each other about the plane P; as such, only one reclining mechanism 80 will be described herein, with the understanding that the opposite reclining mechanism 80 is configured and operates similarly. The reclining mechanisms 80 enable the chair 20 to move between an upright position, in which the seat 24 is generally horizontally disposed and in a first location relative to the frame 22, and in which the backrest 26 forms an angle $\alpha$ with the underlying surface (see FIG. 4), and a reclined position, in which the backrest 26 forms a second angle $\beta$ with the underlying surface that is less than the angle $\alpha$, and the seat 24 is in a second location relative to the frame that is forward of the first location (see FIG. 5).

The backrest mechanism 80 includes a front bracket 82 with a slot 84 that is mounted to the underside of the seat 24, a rear bracket 92 that is mounted to the seat 24 predominantly above the rear portion of the seat 24, a connecting rod 88 that is pivotally interconnected with the rear bracket 86 at a pivot 90 and fixed to the backrest 26, and a mounting link 86 that is mounted to the inner surface 33 of the arm 32 and that is pivotally attached to the connecting rod 88 at a pivot 94.

The backrest reclining mechanism 80 further includes a drive link 102 that is attached to the connecting rod 88 at a pivot 96 and extends downwardly and rearwardly therefrom. A cam unit 105 includes a cam plate 106 and a cam 112 fixed thereto. The cam drive plate 106 has a finger 108 and is attached to the rear end of the drive link 102 at a pivot 10. A cam mounting bracket 116 is mounted to the outer surface of the inner panel 33 of the arm 32; the cam drive plate 106 is attached to the cam mounting bracket 116 at a pivot 118. The cam 112, which has a generally arcuate lower bearing surface 114, is fixed to the cam drive plate 106. The bearing surface 114 is arcuate and rests on the underlying surface to support the rear portion of the chair 20; when the chair 20 is in the upright position, the rear section of the bearing surface 114 is in contact with the underlying surface. A wheel 120 is mounted at a pivot 124 to the front outer surface of the inner panel 33 via a bracket 122.

The backrest 26 can be reclined relative to the seat 24 and arm frame 30 by having the occupant push rearwardly against the backrest 26 (typically this movement can be achieved by the seated occupant pushing forwardly on the arms 32). This movement causes the backrest 26 to pivot about the pivot 94 (counterclockwise from the vantage point of FIG. 3) such that the upper portion of the backrest 26 moves downwardly and rearwardly. In turn, the lower portion of the backrest 26 rises and moves forwardly. This movement drives the seat 24 slightly forwardly and causes its rear portion to rise. The front portion of the seat 24 also rises; its movement is controlled by the interaction between a pin 52*a* on the mounting link 52 and the slot 84 in the front bracket 82. Movement ceases when the front bracket 82 has moved forward sufficiently that the rear end of the slot 84 strikes the pin 52*a*.

In addition, the rotation of the backrest 26 forces the lower end of the connecting rod 88 forwardly. This movement draws the drive link 102 upwardly and forwardly. This action also rotates the cam drive plate 106, and in turn the cam 112, clockwise from the vantage point of FIG. 3. Rotation of the cam 112 causes the bearing surface 114 to "roll" along the underlying surface. As the bearing surface 114 rolls, the frame 22, the seat 24 and the backrest 26 of the chair 20 are driven forward; this movement is facilitated by the wheels 120, which also roll on the underlying surface. Like the movement of the backrest 26, movement of the cam 112 ceases when the front bracket 82 has moved forward sufficiently that the rear end of the slot 84 strikes the pin 52*a*.

It can be seen that, as the backrest 26 reclines, the frame 22 moves forward a distance d1 (FIG. 5) and away from any wall that is immediately adjacent the backrest 26. Consequently, in the upright position the chair 20 can be placed immediately adjacent a neighboring wall and can still recline without the backrest 26 striking the wall. In some embodiments, the chair 20 can be placed within 3 inches of the wall in the upright position without striking the wall as it moves to the reclined position, as the uppermost portion of the backrest 26 moves less than 3 inches rearward relative to the underlying surface.

Those skilled in this art will recognize that variations of the reclining mechanism may also be employed in embodiments of the invention. For example, the bearing surface 114 of the cam 112 may be segmented, rather than smoothly arcuate, in order to encourage the chair 20 to cease movement in particular positions. Alternatively, the bearing surface 114 may not be contiguous as shown in the figures; instead, the bearing surface may have front and rear prongs, spokes, or other bearing surface portions that contact the underlying surface. Moreover, the chair 20 may include a separate base with a stationary contact surface on which the cam rolls (rather than the cam rolling directly on the underlying surface). As an additional alternative, the wheels 120 may be omitted or replaced with a sliding surface. Other alternatives will also be apparent to those skilled in this art.

In addition, although in the illustrated embodiment the backrest mechanism 80 is decoupled from the ottoman extension mechanism 30, in some embodiments of the present invention the backrest mechanism 80 may be coupled with the ottoman extension mechanism 40. Further, those skilled in this art will also recognize that, in some embodiments, one or more of the ottomans 28*a*, 28*b* and ottoman extension mechanism 40 may be omitted, with the result that the chair becomes a pressback-style wall-proximity chair. Such a chair can allow the consumer to employ, for example, a separate ottoman with the chair if desired.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A reclining seating unit, comprising:

a frame having arms on opposing sides thereof, the frame located in a first position relative to an underlying surface that supports the seating unit;

a backrest;

a seat;

a reclining mechanism attached to the frame, backrest and seat, the reclining mechanism comprising a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being larger than the first angle, and the seat is in a second location relative to the frame that is forwardly of the first location;

at least one ottoman moveable between a retracted position beneath the seat and an extended position in front of the seat; and an ottoman extension mechanism attached to the seat and the at least one ottoman;

wherein the reclining mechanism includes a cam unit having a generally arcuate bearing surface in contact with a contact surface when the backrest is in the upright position, wherein movement of the backrest to the reclined position rolls the bearing surface on the contact surface, thereby driving the backrest and seat forward; and wherein the ottoman extension mechanism is decoupled from the reclining mechanism such that the ottoman extension mechanism moves the at least one ottoman between the retracted and extended positions as the reclining mechanism remains stationary relative to the frame, and the reclining mechanism moves the backrest between the upright and reclined positions as the ottoman extension mechanism remains stationary relative to the frame.

2. The reclining seating unit defined in claim 1, wherein the contact surface is the underlying surface that supports the seating unit.

3. The reclining seating unit defined in claim 1, wherein the cam unit is pivotally connected with the frame.

4. The reclining seating unit defined in claim 3, wherein the reclining mechanism includes a drive link pivotally interconnected with the cam unit and with the backrest.

5. The reclining seating unit defined in claim 1, wherein an uppermost end of the backrest moves less than 3 inches rearward relative to the underlying surface when the chair moves from the upright position to the reclined position.

6. The reclining seating unit defined in claim 1, wherein the bearing surface of the cam unit is entirely arcuate.

7. The reclining seating unit defined in claim 1, further comprising wheels attached to the frame and resting on the underlying surface to facilitate forward movement of the frame relative to the underlying surface.

8. A reclining seating unit, comprising:

a frame having arms on opposing sides thereof, the frame located in a first position relative to an underlying surface that supports the seating unit;

a backrest;

a seat;

a reclining mechanism attached to the frame, backrest and seat, the reclining mechanism comprising a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being larger than the first angle, and the seat is in a second location relative to the frame that is forwardly of the first location;

at least one ottoman moveable between a retracted position beneath the seat and an extended position in front of the seat; and an ottoman extension mechanism attached to the seat and the at least one ottoman;

wherein the reclining mechanism includes a cam unit having front and rear bearing surface portions, wherein in the upright position the rear bearing surface portion is in contact with a contact surface, and wherein in the reclined position the front bearing surface portion is in contact with the contact surface, the movement of the backrest from the upright position to the reclined position moving the cam unit, thereby driving the backrest and seat forward; and wherein the ottoman extension mechanism is decoupled from the reclining mechanism such that the ottoman extension mechanism moves the at least one ottoman between the retracted and extended positions as the reclining mechanism remains stationary relative to the frame, and the reclining mechanism moves the backrest between the upright and reclined positions as the ottoman extension mechanism remains stationary relative to the frame.

9. The reclining seating unit defined in claim 8, wherein the contact surface is the underlying surface that supports the seating unit.

10. The reclining seating unit defined in claim 8, wherein the cam unit is pivotally connected with the frame.

11. The reclining seating unit defined in claim 10, wherein the reclining mechanism includes a drive link pivotally interconnected with the cam unit and with the backrest.

12. The reclining seating unit defined in claim 8, wherein an uppermost end of the backrest moves less than 3 inches rearward relative to the underlying surface when the chair moves from the upright position to the reclined position.

13. The reclining seating unit defined in claim 8, wherein the bearing surface portions of the cam unit are contiguous and generally arcuate.

14. The reclining seating unit defined in claim 8, further comprising wheels attached to the frame and resting on the underlying surface to facilitate forward movement of the frame relative to the underlying surface.

15. A reclining seating unit, comprising:

a frame having arms on opposing sides thereof, the frame located in a first position relative to an underlying surface that supports the seating unit;

a backrest;

a seat;

a reclining mechanism attached to the frame, backrest and seat, the reclining mechanism comprising a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being larger than the first angle, and the seat is in a second location relative to the frame that is forwardly of the first location;

at least one ottoman moveable between a retracted position beneath the seat and an extended position in front of the seat; and an ottoman extension mechanism attached to the seat and the at least one ottoman;

wherein the reclining mechanism includes a cam unit pivotally interconnected with the frame and having front and rear bearing surface portions, wherein in the upright position the rear bearing surface portion is in contact with the underlying surface, and wherein in the reclined position the front bearing surface portion is in contact with the underlying surface, the movement of the backrest from the upright position to the reclined position moving the cam unit, thereby driving the backrest and seat forward; and wherein the ottoman extension mechanism is decoupled from the reclining mechanism such that the ottoman extension mechanism moves the at least one ottoman between the retracted and extended positions as the reclining mechanism remains stationary relative to the frame, and the reclining mechanism moves the backrest between the upright and reclined positions as the ottoman extension mechanism remains stationary relative to the frame.

16. The reclining seating unit defined in claim 15, wherein the reclining mechanism includes a drive link pivotally interconnected with the cam unit and with the backrest.

17. The reclining seating unit defined in claim 15, wherein an uppermost end of the backrest moves less than 3 inches rearward relative to the underlying surface when the chair moves from the upright position to the reclined position.

18. The reclining seating unit defined in claim 15, wherein the bearing surface portions of the cam unit are contiguous and generally arcuate.

19. The reclining seating unit defined in claim 15, further comprising wheels attached to the frame and resting on the underlying surface to facilitate forward movement of the frame relative to the underlying surface.

20. A reclining seating unit, comprising:

a frame having arms on opposing sides thereof, the frame located in a first position relative to an underlying surface that supports the seating unit;

a backrest;

a seat;

a reclining mechanism attached to the frame, backrest and seat, the reclining mechanism comprising a series of pivotally interconnected links, the links configured and arranged to move the backrest and seat between an upright position, in which the seat is generally horizontally disposed and in a first location relative to the frame and the backrest forms a first angle with the seat, and a reclined position, in which the backrest forms a second angle with the seat, the second angle being larger than the first angle, and the seat is in a second location relative to the frame that is forwardly of the first location;

at least one ottoman moveable between a retracted position beneath the seat and an extended position in front of the seat; and an ottoman extension mechanism attached to the seat and the at least one ottoman;

wherein the reclining mechanism includes a cam unit having a generally arcuate bearing surface in contact with a contact surface when the backrest is in the upright position, wherein movement of the backrest to the reclined position rolls the bearing surface on the contact surface, thereby driving the backrest and seat forward; and wherein the ottoman extension mechanism and the reclining mechanism operate independently of each other such that the ottoman extension mechanism moves the at least one ottoman between the retracted and extended positions as the reclining mechanism remains stationary relative to the frame, and the reclining mechanism moves the backrest between the upright and reclined positions as the ottoman extension mechanism remains stationary relative to the frame.

* * * * *